United States Patent [19]

Uchida

[11] Patent Number: 4,880,461

[45] Date of Patent: Nov. 14, 1989

[54] SUPER HARD HIGH-SPEED TOOL STEEL

[75] Inventor: Norimasa Uchida, Yonago, Japan

[73] Assignee: Hitachi Metals, Ltd., Tokyo, Japan

[21] Appl. No.: 139,161

[22] Filed: Dec. 21, 1987

Related U.S. Application Data

[63] Continuation of Ser. No. 897,402, Aug. 18, 1986, abandoned.

[30] Foreign Application Priority Data

Aug. 18, 1985 [JP] Japan ..... 60-181555
Aug. 18, 1985 [JP] Japan ..... 60-181556
Aug. 18, 1985 [JP] Japan ..... 60-181557

[51] Int. Cl.[4] ..... C22C 29/04

[52] U.S. Cl. ..... 75/238; 75/236; 75/237; 75/239; 75/241; 75/243; 75/244; 75/246; 419/38; 419/29; 420/10; 420/11; 420/12; 420/15; 420/27

[58] Field of Search ..... 75/236, 237, 238, 239, 75/241, 242, 244, 246, 243; 420/10, 11, 12, 15, 27; 419/29, 38

[56] References Cited

U.S. PATENT DOCUMENTS 3,409,419 11/1968 Yates ..... 75/238
3,869,037 3/1975 Henry et al. ..... 420/15
4,121,929 10/1978 Kawai et al. ..... 75/238
4,121,930 10/1978 Yukawa et al. ..... 75/238
4,140,527 2/1979 Kawai et al. ..... 75/244
4,249,945 2/1981 Haswell et al. ..... 75/241
4,469,514 9/1984 Hultz, Jr. ..... 75/241
4,519,839 5/1985 Toyoaki et al. ..... 75/242
4,599,109 7/1986 Kawai et al. ..... 75/238

FOREIGN PATENT DOCUMENTS 61-117250 6/1986 Japan ..... 420/15
2165553 4/1986 United Kingdom ..... 75/239

*Primary Examiner*—Stephen J. Lechert, Jr.

[57] ABSTRACT

A super hard high-speed tool steel having a composition satisfying the condition of $0 \leqq C - Ceq \leqq 0.6$ (where $Ceq = 0.06Cr + 0.033\ W + 0.063\ Mo + 0.2\ V$ within the range of $1.7 \leqq C \leqq 4.1\%$, the composition containing 3 to 10% of Cr, 1 to 20% of W, 1 to 15% of Mo (where $18 \leqq W + 2Mo \leqq 40$), 1 to 15% of V, not greater than 15% of Co, not greater than 2% of Si, not greater than 1% of Mn, and the balance substantially Fe and inevitable impurities, the steel further containing in uniformly dispersed state 2 to 12% in total of one, two or more selected from a group consisting of nitrides, carbides and carbonitrides of Ti, V, Zr, Nb, Hf and Ta in the composition. This tool steel exhibits a distinguished hardness of HRC 71 or higher, as well as toughness.

7 Claims, 3 Drawing Sheets

SUPER HARD HIGH-SPEED TOOL STEEL

This application is a continuation of application Ser. No. 897,402, filed Aug. 18, 1986, now abandoned.

BACKGROUND OF THE INVENTION

1. Field of the Invention

The present invention relates to a high-speed tool steel which can exhibit, through an ordinary hardening-and-tempering treatment, a high hardness of HRC 71 or higher.

2. Description of the Prior Art

Hitherto, only few proposals have been made as to high-speed tool steels having high hardness of HRC 71 or higher. These proposals are made only partially in Japanese Patent Publication No. 6096/80 entitled "Hard Alloy", Japanese Patent Publication No.21 42/82 entitled "High-Speed Tool Steel Enriched with Carbides", Japanese Patent Application Laid-Open Publication No. 181367/82 entitled "Sintered High-V High-Speed Tool Steel and Method of Producing the Same", and Japanese Patent Application Laid-Open Publication No. 181848/83 entitled "Nitride-Containing Sintered High-V High-Speed Tool Steel and Method of Producing the Same".

According to the known techniques, in order to obtain a high hardness of HRC 71 or higher, it is necessary to increase the content of expensive alloying element such as W, Mo, V, etc., or to disperse a large amount of hard substance such as TiN, etc., resulting in various inconveniences such as a rise in the production cost and deteriorations of machinability and toughness. For instance, in the embodiment shown in Japanese Patent Publication No. 2142/82, only the steel samples Nos. 5 and 11 (Tables 1 and 2) provide the high hardness of HRC 71 or higher. These steels, however, have impractically high contents of W+2Mo of 49.0% and 49.7%, respectively.

Also in the embodiment shown in Japanese Patent Application Laid-Open Publication No. 181367/82, a hardness of HRC 71 or higher is obtained only when the V content is increased beyond 25% (see FIG. 2). Further, also in case of the steel disclosed in Japanese Patent Application Laid-Open Publication No. 181848/83, a high hardness of HRC 71 or higher cannot be obtained unless the TiN is dispersed by an amount not smaller than 15%.

SUMMARY OF THE INVENTION

Accordingly, an object of the invention is to provide a high-speed tool steel which is capable of exhibiting a high hardness of HRC 71 or higher through an ordinary hardening-and-tempering treatment, even with comparatively small content of expensive alloying element such as W, Mo, V, etc. or of the hard substance such as TiN, etc.

The present invention is based upon a discovery that, assuming a value Ceq is given by Ceq=0.06 Cr+0.03 W+0.063 Mo+0.2 V, a high hardness equal to or higher than the hardness of conventional high-speed tool steel is obtainable even with comparatively small content of the alloying element such as W, Mo, V, etc. or of the hard substance such as TiN, etc., when a value of C−Ceq falls within a specified range.

More specifically, the above-described object of the invention can be achieved by a super hard high-speed tool steel having a composition containing 1.7 to 4.1% of C, not greater than 2% of Si, not greater than 1% of Mn, 3 to 10% of Cr, 1 to 20% of W, 1 to 15% of Mo (where $18 \leqq W+2Mo \leqq 40$), 1 to 15% of V, not greater than 15% of Co and, as required, not greater than 2% of Ni and no greater than 0.1% of N, and the balance substantially Fe and inevitable impurities, the steel further containing in uniformly dispersed state 2 to 12% in total of one, two or more selected from a group consisting of nitrides, carbides and carbonitrides of Ti, V, Zr, Nb, Hf and Ta in the composition, wherein the condition of $0 \leqq C-Ceq \leqq 0.6$ is met, where Ceq is given by Ceq=0.06 Cr+0.033 W+0.063 Mo+0.2 V.

The present invention can be carried out in the following three Forms:

Form 1

A super hard high-speed tool steel having a composition satisfying the condition of $0 \leqq C-Ceq \leqq 0.6$ (where Ceq=0.06 Cr+0.033 W+0.063 Mo+0.2 V) within the range of $2.25 \leqq C \leqq 4.1\%$, the composition containing 3 to 10% of Cr, 1 to 20% of W, 1 to 15% of Mo (where $24.1 \leqq W+2Mo \leqq 40$), 1 to 15% of V, not greater than 15% of Co, not greater than 2% of Si, not greater than 1% of Mn, and, as required, not greater than 2% of Ni and not greater than 1% of N, and the balance substantially Fe and inevitable impurities, the steel further containing in uniformly disperse state 2 to 12% in total of one, two or more selected from a group consisting of nitrides, carbides and carbonitrides of Ti, V, Zr, Nb, Hf and Ta in the composition.

Form 2

A super hard high-speed tool steel having a composition satisfying the condition of $0.1 \leqq C-Ceq \leqq 0.6$ (where Ceq=0.06 Cr+0.033 W+0.063 Mo+0.2 V) within the range of $2.0 \leqq C \leqq 3.5\%$, the composition containing 3 to 10% of Cr, 1 to 20% of W, 1 to 11% of Mo (where $18 \leqq W+2Mo \leqq 24$), 5.6 to 15% of V, not greater than 15% of Co, not greater than 2% of Si, not greater than 1% of Mn, and, as required, not greater than 2% of Ni and not greater than 0.1% of N, and the balance substantially Fe and inevitable impurities, the steel further containing in uniformly dispersed state 2 to 12% in total of one, two or more selected from a group consisting of nitrides, carbides and carbonitrides of Ti, V, Zr, Nb, Hf and Ta in the composition.

Form 3

A super hard high-speed tool steel having a composition satisfying the condition of $0 \leqq C-Ceq \leqq 0.6$ (where Ceq=0.06 Cr+0.033 W+0.063 Mo+0.2V) within the range of $1.7 \leqq C \leqq 2.8\%$, the composition containing 3 to 10% of Cr, 1 to 20% of W, 1 to 11% of Mo (where $18 \leqq W+2Mo \leqq 24$), 1 to 5.5% of V, not greater than 15% of Co, not greater than 2% of Si, not greater than 1% of Mn, and, as required, not greater than 2% of Ni and not greater than 0.1% of N, and the balance substantially Fe and inevitable impurities, the steel further containing in uniformly dispersed state 2 to 12% in total of one, two or more selected from a group consisting of nitrides, carbides and carbonitrides of Ti, V, Zr, Nb, Hf and Ta in the composition.

The super hard high-speed tool steel of the invention can be produced by uniformly mixing 88 to 98% of the atomized powder of the high-speed tool steel having the above-mentioned composition, and 2 to 12% in total of one, two or more selected from the group consisting of the nitrides, carbides and carbonitrides of Ti, Zr, V, Nb, Hf and Ta, and compacting and sintering the mixture.

In the invention, the content of C is the most important constituent element. Namely, C has an effect of forming carbides such as $M_6C$, MC and so forth by combining with other coexisting elements Cr, W, Mo and V thereby providing the wear resistance, and an effect of increasing the hardness of martensite matrix through a hardening heat treatment as well as enhancing the secondary hardening increment in tempering. It has been theoretically known that the equilibrium carbon content Ceq, which is stoichiometrically just enough for C to for carbides of the above-mentioned carbide formers Cr, W, Mo and V, is expressed as follows:

$$Ceq=0.06\ (\%\ Cr)+0.033\ (\%\ W)+0.063\ (\%\ Mo)+0.2\ (\%\ V).$$

In the conventional high-speed tool steels, the content of C is adjusted such that the difference C−Ceq between the C content and the equilibrium carbon content Ceq has a negative value. For example, the value of the difference C−Ceq is about −0.3 in case of AISI M7 and −0.05 in case of AISI M42.

The present inventor has made various experiments and studies on many steel systems, in order to obtain a high-speed tool steel having a high hardness of HRC 71 or higher and, hence, a high utility even with comparatively low content of element such as W, Mo and V or of dispersed particles of TiN and so forth.

Through the experiments and studies, the present inventor has found that a satisfactory result is obtained when the C content is adjusted to meet the condition of $0 \leqq C-Ceq \leqq 0.6$, where Ceq is given by $Ceq=0.06\ Cr+0.033\ W+0.063\ Mo+0.2\ V$, unlike the conventional tool steels in which the difference C−Ceq takes a negative value, within the range of $18 \leqq W+2Mo \leqq 40$. When the difference value C−Ceq is below 0 (zero), high hardness of HRC 71 or higher cannot be obtained unless the contents of W, Mo, V and TiN are increased as mentioned above. Conversely, if the difference value C−Ceq exceeds 0.6, the amount of stable residual austenite is extremely increased after a hardening heat treatment and the decomposition temperature of the residual austenite is shifted to the higher temperature side, with a result that the high hardness of HRC 71 or higher cannot be obtained even if subjected to a secondary hardening in tempering. Thus, the object of the present invention can be accomplished only when the condition of $0 \leqq C-Ceq \leqq 0.6$ is met within the range of $18 \leqq W+2Mo \leqq 40$.

As stated before, it is desirable that the present invention is carried out in one of the aforesaid three Forms, for the reasons which will be explained hereinunder.

Namely, a high resistance to wear such as abrasive wear and adhesive wear is obtained by increasing the W and Mo contents in the high-speed tool steel so as to obtain a large amount of precipitation of $M_6C$ carbides in the matrix (Form 1).

The increased W and Mo contents, however, reduce the toughness, so that it is necessary to suitably suppress the precipitation amount of the $M_6C$ in the matrix when the balance between the wear resistance and the toughness is taken into consideration (Form 2).

Further, when a high grindability is specifically required besides the wear resistance and the toughness, it is necessary to adjust the V content to be comparatively low, so as to suppress the precipitation amount of VC carbides (Form 3).

Thus, the Form 1 is suitable for the uses which require wear resistance above all, because it exhibits a high resistance to wear such as abrasive wear and adhesive wear, by virtue of a large precipitation amount of $M_6C$ carbides in the high-speed tool steel matrix, at a cost of comparatively low toughness.

In the Form 2, toughness is improved by suppressing the amount of carbide precipitated in the high-speed tool steel matrix, but the reduction in adhesive wear resistance is low owing to the effect produced by the dispersed particles. The Form 2, therefore, is suitable for the uses where both the wear resistance and toughness are required.

The Form 3 is suitable for the uses where the grindability is important besides the wear resistance and toughness. The Form 1 exhibits the highest hardness, and the Forms 2 and 3 exhibit an intermediate and lowest hardness levels. More specifically, the Form 1 exhibits a hardness not lower than HRC 72 or 73, the Form 2 exhibits a hardness not lower than HRC 72 and the Form 3 exhibits a hardness not lower than HRC 71.

An explanation will be given hereinunder as to the reasons of numerical restrictions on the contents of the constituent elements.

As stated before, the C content should be varied in accordance with the contents of coexisting Cr, W, Mo and V. The C content should be at least 1.7%, in order to meet the condition of $0 \leqq C-Ceq \leqq 0.6$ within the content ranges of Cr, W, Mo and V in the invention mentioned later. On the other hand, a C content exceeding 3.5% causes a serious reduction in the toughness, even though the above-mentioned condition is met. The carbon content, therefore, is limited to meet the condition of $0 \leqq C-Ceq \leqq 0.6$, within the C content range of 1.7 to 3.5%.

Further, explaining in detail about each of the aforesaid Forms, in order to meet the following conditions within the content ranges of Cr, W, Mo and V in respective Forms of the invention which will be mentioned later:

$$0 \leqq C-Ceq \leqq 0.6 \quad \text{(Form 1)}$$

$$0.1 \leqq C-Ceq \leqq 0.6 \quad \text{(Form 2)}$$

$$0 \leqq C-Ceq \leqq 0.6 \quad \text{(Form 3)}$$

the C content has to be at least 2.25%, 2.0% and 1.7% in the Forms 1, 2 and 3, respectively. On the other hand, in each Form, even if the above-mentioned conditions are met, the reduction in the toughness becomes serious when the C content exceeds 3.5%, 3.5% and 2.8%, respectively, so that the C content in each Form has to meet the following conditions:

$$2.25 \leqq C \leqq 3.5\% \text{ and } 0 \leqq C-Ceq \leqq 0.6 \quad \text{(Form 1)}$$

$$2.0 \leqq C \leqq 3.5\% \text{ and } 0.1 \leqq C-Ceq \leqq 0.63 \quad \text{(Form 2)}$$

$$1.7 \leqq C \leqq 2.8\% \text{ and } 0 \leqq C-Ceq \leqq 0.6 \quad \text{(Form 3).}$$

Further, in the Form 2, the condition of $0.1 \leqq C-Ceq \leqq 0.6$ is adopted because a high hardness exceeding HRC 72 is obtained when the difference value C−Ceq is 0.1 or higher.

Cr has an effect of increasing the quench hardenability. This effect, however, does not become appreciable when Cr content is below 3%. On the other hand, a Cr content exceeding 10% increases the amount of residual austenite thereby lowering the hardness in hardening and tempering. For these reasons, the Cr content is limited to a range between 3 and 10%, in all of the Forms 1, 2 and 3. Especially, for obtaining a high hardness of HRC 72 or higher even when a heat treatment is conducted in a quenching furnace of a low cooling rate such as vacuum quenching, it is desirable that the Cr content exceed 6% but is not higher than 10%.

As stated before, W and Mo form, combining with C, carbides of $M_6C$ type thereby improving the wear resistance. In addition, these elements dissolve during hardening heat treatment into the matrix, and during tempering heat treatment precipitate as fine carbide thereby enhancing the degree of secondary hardening.

In order that in the invention the high hardness of HRC 71 or higher is obtained, it is necessary that the content of W+2Mo is 18% or greater, within the W content range of 1 to 20% and the Mo content range of 1 to 11%.

Furthermore, in order to obtain as in the Form 1 a high resistance to wear such as abrasive wear and adhesive wear, the content of W+2Mo should be not smaller than 24.1%, within the W content range of 1 to 20% and the Mo content range of 1 to 15%. However, when the content of W+2Mo exceeds 40%, the amount of primary carbides of $M_6C$ type is extremely increased thereby lowering the toughness. For these reasons, in the Form 1, the W and Mo contents are limited to 24.1 to 40% in terms of W+2Mo. Further, as in the Form 1 or 2, in case where a suitable balance between the wear resistance and the toughness is important, or in case where a grindability is important besides the wear resistance and the toughness, it is necessary that the content of W+2Mo be limited to 18 to 24%. Further, in the invention, W and Mo in equal amount in terms of atomic percent have a substantially equivalent effect.

Similarly to W and Mo, V forms MC type carbides by combining with C. The MC type carbides exhibit hardness of Hv 2500 to 3000 which is extremely high as compared with that (Hv 1500 to 1800) of the $M_6C$ type carbides. Therefore, tools required to have distinguished wear resistance are preferably made of a high-speed tool steel having a high V content.

Unlimited increase in the V content, however, deteriorates the grindability and causes a shortening in the life due to softening in grinding, and lowers the toughness undesirably. In the present invention, therefore, the V content is limited to be not greater than 15%. On the other hand, a V content below 1% does not cause appreciable precipitation of the MC type carbides, failing to improve the wear resistance significantly. The V content, therefore, is limited to a range between 1 and 15%. However, when a superior grindability is required as in the Form 3, it is necessary that the V content of the matrix is selected to be small so as to suppress the precipitation amount of VC, so that the V content is limited to a range between 1 and 5.5%.

Co is an element which dissolves into the matrix thereby bringing about an effect of increasing the temper hardness and high-temperature hardness. A too large Co content, however, seriously deteriorates the toughness, so that the Co content is limited to be not greater than 15%.

Not greater than 2% of Si is added for the purpose of deoxidation. The addition of Si especially in a range between 0.8 and 2% brings about various effects such as effect of increasing the hardness of the matrix, effect of increasing the oxidation resistance and the corrosion resistance, as well as effect of improving the workability in atomization, besides the deoxidation effect. An Si content exceeding 2%, however, causes a serious deterioration in the toughness.

Mn also provides a deoxidation effect and has an additional function of increasing the hardenability. For obtaining appreciable effects, Mn is added by an amount which is not greater than 1%. In particular, when the Si content is high, since the detrimental effect of Si in stabilizing the ferrite thereby raising the $A_1$ transformation point can be relieved by Mn, it is preferable that Mn is contained in a range between 0.25 and 1.0%.

Ni has an effect of increasing the toughness of the matrix. An Ni content exceeding 2%, however, extremely increases the amount of residual austenite, resulting in a lowered temper hardness. In the present invention, therefore, the Ni content is suitably limited within a range not greater than 2%.

N has an effect of increasing the hardness of the matrix and an effect of dissolving into MC type carbide to form MCN type carbonitride thereby increasing the adhesion resistance property. From an industrial point of view, however, the upper limit of N content is limited to 0.1%, so that the N content is suitably limited to a range not greater than 0.1%.

Dispersion of nitrides, carbides and carbonitrides of Ti, V, Zr, Nb, Hf and Ta has an effect of increasing the hardness. On the other hand, it has been a common understanding that, when the C content is higher than the equilibrium carbon content (Ceq) by 0.1 to 0.6%, the austenite crystal grains are coarsened during the hardening treatment, so that the martensite structure becomes coarse resulting in a serious reduction in the toughness. However, it has been found that according to the invention this drawback can be solved by uniformly dispersing 2 to 12% in total of one, two or more selected from a group consisting of nitrides, carbides and carbonitrides of Ti, V, Zr, Nb, Hf and Ta, so that an extremely fine structure is obtained even when the hardening treatment is conducted at a high austenitizing temperature which is immediately below the solidus temperature. Namely, the aforesaid dispersion of the nitrides, carbides and carbonitrides well compensates for the drawback produced by the C content exceeding Ceq, thus fulfilling the object of the invention.

This effect, however, is not appreciable when the total content is below 2%. On the other hand, a total content exceeding 12% not only causes a saturation in the above-explained effect but also lowers the grindability and the toughness. For these reasons, the total amount of dispersion of the nitrides, carbides and carbonitrides is limited to a range between 2 and 12%. The uniform dispersion of the nitrides, carbides and carbonitrides in the matrix can be carried out most adequately by forming powder of the high-speed tool steel of the described composition by atomizing with the aid of water, gas, oil or the like, and mixing the thus obtained power with the powders of the nitrides, carbides and carbonitrides, followed by compacting and sintering.

Preferably, carbon powder such as graphite powder, black carbon or the like is added during the mixing, for the purposes of adjusting the final carbon content and improving the sintering ability. An appreciable improvement in the sintering ability is obtained when not greater than 5% in total of powders of one, two or more elements selected from a group consisting of Cr, Ni, Mo, W, Cu, Co and Fe is simultaneously added.

DESCRIPTION OF THE EMBODIMENTS

Figure 1:
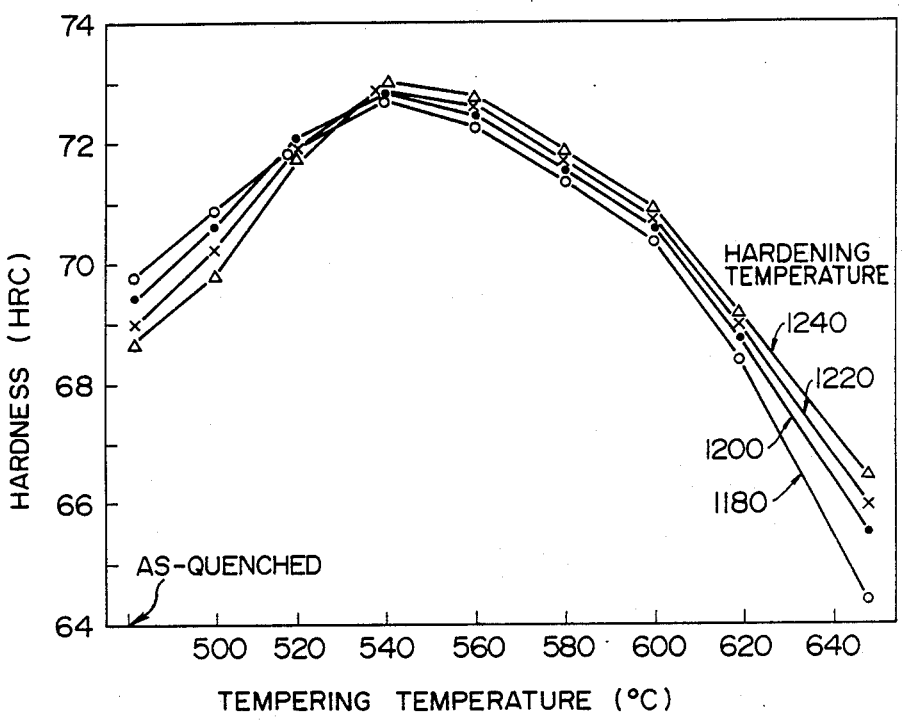
FIG. 1 is a chart showing how the hardness of the steel No. 2 in Table 1 is changed by hardening temperature and tempering temperature.

The invention will be fully understood from the following description.

Example 1

Powders of 30 kinds respectively having the basic composition shown in Table 1 were produced by water atomizing method. The powders were further ground into smaller grain sizes and were classified by a screen of 350 mesh. Then, powders of TiN, TiCN, NbC, NbN, VN, ZrN and TaC, having an average grain size of 1 to 10 μm, were mixed with the classified powders at the rates shown in Table 1. After adding carbon powder by amount equivalent to the oxygen content of the powders, the mixture was wet-blended for 36 hours by means of a ball mill. Then, after drying, the mixture was compacted by a cold isostatic pressing under a pressure of 6 t/cm$^2$. The thus formed compact was then sintered at a temperature of 1180° to 1250° C. in a vacuum, and thereafter sintered to a true density by a hot isostatic pressing. The high-speed tool steels (Nos. 1 to 30 in Table 1) obtained in this way were, after being annealed, subjected to a hardening-and-tempering treatment, and their hardnesses were measured. The hardening was effected by dipping the steel in a salt bath of 1180° to 1260° C., followed by oil quenching, while the tempering was conducted three times in the air under the condition of 560° C.×1 hour. The results of measurement of the hardness after the tempering are also shown in Table 1. It will be seen that all the steels Nos. 1 to 24 of the invention exhibit high hardness of HRC 71 or higher. In particular, the steels Nos. 1 to 9 corresponding to the aforesaid Form 1 stably exhibit high hardness of HRC 72 or higher, or HRC 73 or higher. On the other hand, comparison steels Nos. 25 to 28 cannot provide sufficient hardness, due to the fact that the value C−Ceq does not meet the condition specified in the invention, although the basic composition and the amount of dispersed particles fall within the ranges specified in the invention. A conventional steel No. 29 exhibits an extremely low hardness of HRC 68.6, due to the fact that the value C−Ceq is as small as −0.5, although the W and Mo contents are so high as to meet the conditions of W+2Mo=32.5%. The steel No. 30, which is also a conventional steel, exhibits only a low hardness of HRC 68.9, although the TiN particles are dispersed by a comparatively large amount of about 10%, due to the facts that the value C−Ceq is as small as −0.13 and that the W and Mo contents are as small as W+2Mo=16.4.

TABLE 1

| | basic composition | | | | | | | | | | | | dispersed particles | tempered hardness | |
|---|---|---|---|---|---|---|---|---|---|---|---|---|---|---|---|
| | C | Si | Mn | Ni | Cr | W | Mo | V | Co | N | C-Ceq | W + 2Mo | content (%) | (at +560° C.) | remarks |
| Form 1 | | | | | | | | | | | | | | | |
| 1 | 2.26 | 0.4 | 0.3 | 0.1 | 4.2 | 9.9 | 7.7 | 4.4 | 8.1 | 0.04 | +0.32 | 25.3 | TiN 12 | HRC 72.9 | (1) |
| 2 | 2.89 | 0.3 | 0.3 | 0.1 | 4.0 | 10.1 | 7.8 | 7.6 | 8.1 | 0.04 | +0.31 | 25.7 | TiN 9 | 73.0 | " |
| 3 | 3.44 | 0.4 | 0.3 | 0.1 | 3.9 | 12.3 | 8.7 | 9.4 | 10.0 | 0.05 | +0.37 | 29.7 | TiN 6 | 73.1 | " |
| 4 | 3.91 | 0.5 | 0.2 | 1.5 | 3.8 | 4.0 | 10.3 | 12.2 | 8.2 | 0.04 | +0.41 | 24.6 | TiN 2 | 72.8 | " |
| 5 | 3.73 | 1.2 | 0.6 | 0.1 | 6.4 | 4.4 | 10.1 | 11.0 | 8.0 | 0.08 | +0.36 | 24.6 | TiN 2 | 73.4 | " |
| 6 | 2.80 | 0.3 | 0.3 | 0.1 | 4.2 | 9.8 | 8.0 | 7.3 | 7.9 | 0.03 | +0.26 | 25.8 | ZrN 5<br>NbC 4 | 72.9 | " |
| 7 | 2.96 | 0.3 | 0.3 | 0.1 | 4.0 | 9.8 | 8.2 | 7.5 | 7.9 | 0.04 | +0.38 | 26.2 | VN 3<br>TiCN 6 | 73.1 | " |
| 8 | 2.21 | 0.4 | 0.3 | 1.2 | 3.7 | 15.2 | 4.8 | 3.8 | 12.5 | 0.08 | +0.42 | 24.8 | NbN 10<br>TaC 2 | 72.5 | " |
| 9 | 3.25 | 0.7 | 0.2 | 0.03 | 4.4 | 10.5 | 8.4 | 8.8 | 10.2 | 0.02 | +0.35 | 27.3 | ZrN 10<br>TaC 2 | 73.2 | " |
| Form 2 | | | | | | | | | | | | | | | |
| 10 | 2.45 | 0.4 | 0.2 | 0.1 | 4.2 | 7.9 | 5.7 | 5.8 | 8.1 | 0.04 | +0.42 | 19.3 | TiN 12 | 72.4 | " |
| 11 | 3.03 | 0.4 | 0.2 | 0.1 | 3.8 | 9.6 | 7.0 | 9.4 | 10.1 | 0.04 | +0.39 | 23.6 | TiN 6 | 73.1 | " |
| 12 | 2.43 | 0.8 | 0.4 | 0.04 | 6.5 | 17.7 | 4.1 | 5.9 | 9.8 | 0.02 | +0.18 | 20.9 | ZrN 5<br>VC 5 | 72.4 | " |
| 13 | 3.49 | 0.3 | 0.2 | 1.1 | 3.7 | 2.1 | 9.8 | 12.1 | 4.9 | 0.03 | +0.16 | 21.7 | TiCN 3 | 72.1 | " |
| 14 | 3.48 | 0.3 | 0.2 | 0.1 | 4.1 | 2.0 | 10.3 | 10.8 | 4.8 | 0.08 | +0.36 | 22.6 | NbC 2<br>VN 2 | 72.5 | " |
| 15 | 4.19 | 0.5 | 0.3 | 1.5 | 6.2 | 2.3 | 10.5 | 13.4 | 0.3 | 0.06 | +0.40 | 23.3 | NbN 10<br>TaC 2 | 72.2 | " |
| 16 | 2.14 | 0.4 | 0.2 | 0.1 | 4.0 | 8.9 | 6.5 | 4.3 | 8.0 | 0.04 | +0.34 | 21.9 | TiN 9 | 72.6 | " |
| Form 3 | | | | | | | | | | | | | | | |
| 17 | 2.32 | 0.4 | 0.3 | 0.2 | 3.9 | 8.7 | 6.4 | 4.5 | 7.8 | 0.04 | +0.50 | 21.5 | TiN 9 | 73.2 | " |
| 18 | 2.14 | 0.4 | 0.2 | 0.1 | 4.0 | 8.9 | 6.5 | 4.3 | 8.0 | 0.04 | +0.34 | 21.9 | TiN 9 | 72.6 | " |
| 19 | 1.82 | 1.3 | 0.2 | 0.1 | 4.1 | 9.4 | 7.0 | 1.8 | 8.1 | 0.05 | +0.46 | 23.4 | TiN 6<br>TiC 2 | 72.4 | " |
| 20 | 1.97 | 0.4 | 0.3 | 0.06 | 6.1 | 12.5 | 4.4 | 3.8 | 9.8 | 0.03 | +0.15 | 21.3 | ZrN 5<br>VC 2 | 71.9 | " |
| 21 | 1.84 | 0.6 | 0.2 | 1.4 | 3.7 | 8.8 | 6.5 | 3.8 | 10.5 | 0.03 | +0.16 | 21.8 | NbC 2<br>VN 8 | 72.8 | " |
| 22 | 2.10 | 0.3 | 0.2 | 0.1 | 6.3 | 8.9 | 6.3 | 4.6 | 7.9 | 0.03 | +0.11 | 21.5 | ZrN 6 | 72.2 | " |

TABLE 1-continued

| | basic composition | | | | | | | | | | | | dispersed particles | tempered hardness | |
|---|---|---|---|---|---|---|---|---|---|---|---|---|---|---|---|
| | C | Si | Mn | Ni | Cr | W | Mo | V | Co | N | C-Ceq | W + 2Mo | content (%) | (at +560° C.) | remarks |
| 23 | 2.11 | 0.6 | 0.3 | 0.1 | 4.0 | 8.7 | 6.4 | 4.5 | 8.3 | 0.08 | +0.28 | 21.5 | TaC 2<br>NbN 4 | 72.4 | " |
| 24 | 2.21 | 0.4 | 0.4 | 1.5 | 6.2 | 2.4 | 10.1 | 3.5 | 0.3 | 0.07 | +0.42 | 22.6 | TiC 2<br>NbN 10 | 72.0 | " |
| 25 | 2.60 | 0.4 | 0.4 | 0.23 | 4.1 | 10.4 | 8.1 | 8.2 | 8.1 | 0.04 | −0.14 | 26.6 | TaC 2<br>TiN 9 | 68.6 | (2) |
| 26 | 2.31 | 0.4 | 0.3 | 0.08 | 3.8 | 9.0 | 6.1 | 7.3 | 7.9 | 0.03 | −0.06 | 21.2 | TiN 9 | 70.3 | " |
| 27 | 1.92 | 0.3 | 0.3 | 0.2 | 4.2 | 8.9 | 6.5 | 5.0 | 7.9 | 0.03 | −0.04 | 21.9 | TiN 9 | 70.2 | " |
| 28 | 1.75 | 0.4 | 0.3 | 0.1 | 3.9 | 9.2 | 6.5 | 4.8 | 8.2 | 0.03 | −0.16 | 22.2 | TiN 9 | 69.2 | " |
| 29 | 2.52 | 0.4 | 0.3 | 0.1 | 3.9 | 12.1 | 10.2 | 8.6 | 11.9 | 0.04 | −0.5 | 32.5 | — | 68.6 | (3) |
| 30 | 1.32 | 0.3 | 0.3 | 0.1 | 3.9 | 9.8 | 3.3 | 3.4 | 9.7 | 0.03 | −0.13 | 16.4 | TiN 10 | 68.9 | " |

(1): steel of invention
(2): comparison steel
(3): conventional steel

FIG. 1 shows the hardened-and-tempered hardness curves of the steel No. 2 in Table 1, when hardened at 1180° to 1240° C. and tempered at 500° to 650° C. The steel No. 2 exhibits a hardness exceeding HRC 73 when the tempering temperature is 540° C., and, even when the tempering temperature is 560° C., the hardness can reach HRC 73 at the highest.

Figure 2:
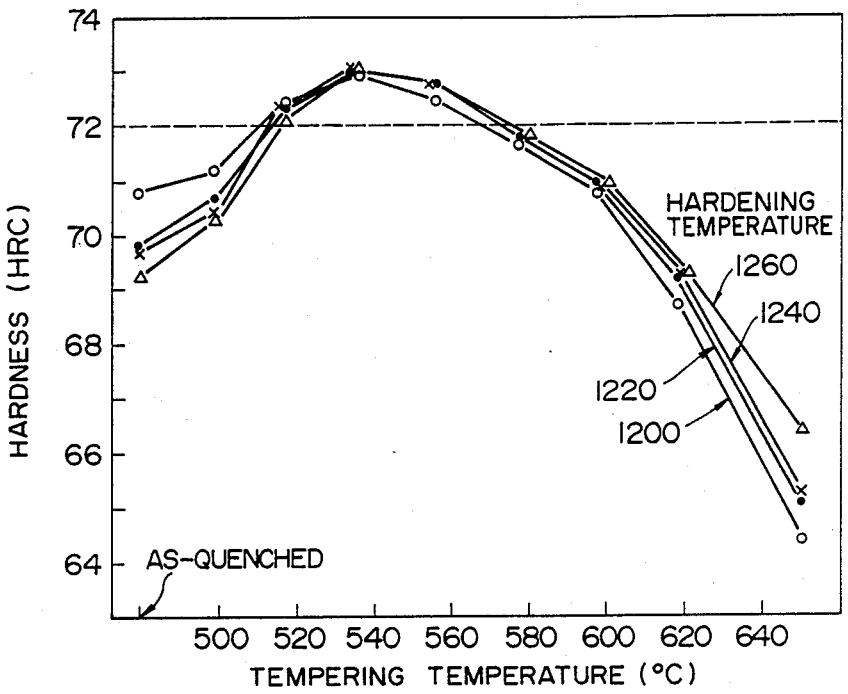
FIG. 2 is a chart showing how the hardness of the steel No. 16 in Table 1 is changed by hardening temperature and tempering temperature.
Figure 3:
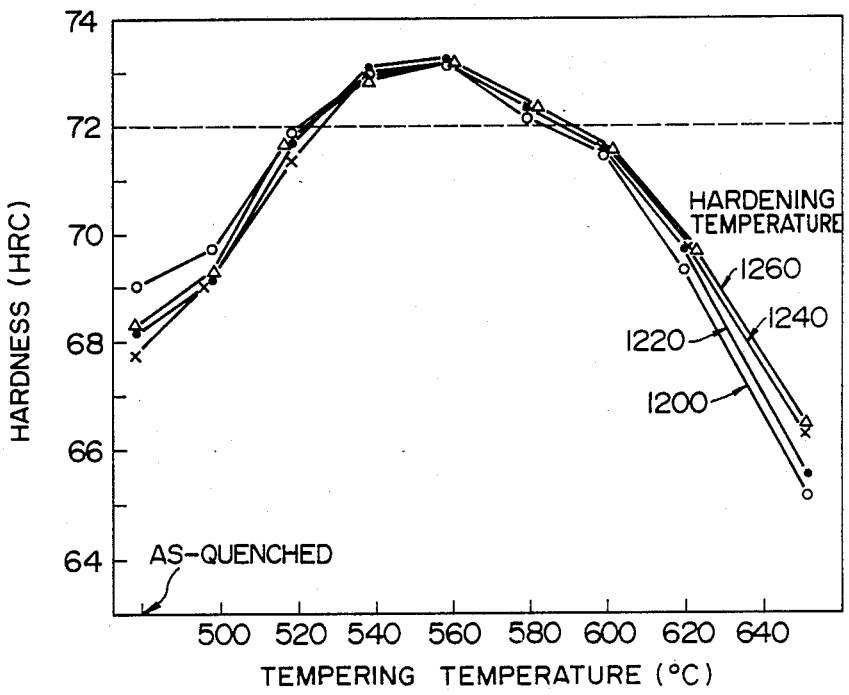
FIG. 3 is a chart showing how the hardness of the steel No. 17 in Table 1 is changed by hardening temperature and tempering temperature.

FIG. 2 shows the hardened-and-tempered hardness curves of the steel No. 16 in Table 1 when hardened at 1200° to 1260° C. and tempered at 500° to 650° C., and similarly FIG. 3 shows the hardened-and-tempered hardness curves of the steel No. 17 in Table 1. The steel No. 16 exhibits a high hardness of HRC 72 or higher when the tempering is effected at 520° to 570° C., and the highest hardness is obtained when the tempering temperature is 540° C. On the other hand, the steel No. 17 posesses a wider range of the tempering temperature for obtaining high hardness of HRC 72 or higher and a higher level of the highest hardness, as compared with the steel No. 16. The tempering temperature for attaining the highest hardness, however, has been shifted to the higher temperature side, i.e., to 560° C. This proves that the decomposition of the residual austenite is becoming gradually difficult. A further shift of the peak temperature to the higher temperature side causes the highest hardness to be lowered.

Figure 4:
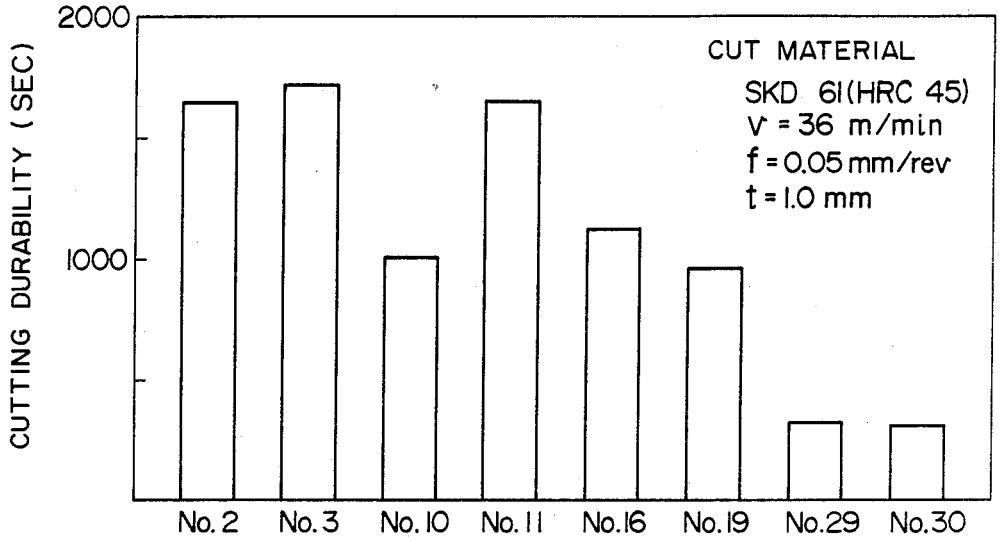
FIGS. 4 and 5 are illustrations of the results of cutting test conducted with point nose straight tools made of a steel of the invention and a conventional steel, respectively.
Figure 5:
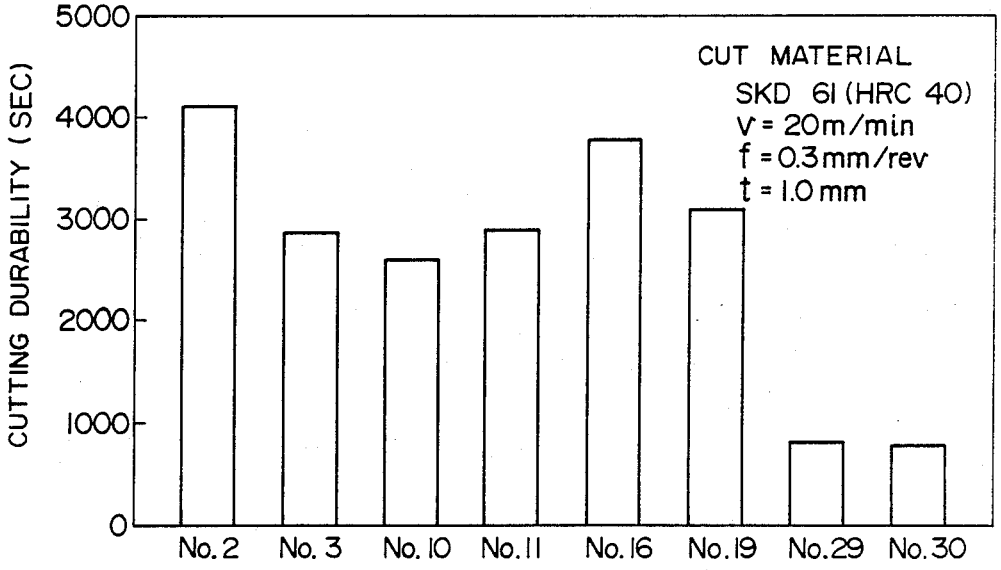

Point nose straight tools were produced by using the high-speed tool steels Nos. 2, 3, 10, 11, 16, 19, 29 and 30 in Table 1, and a cutting test was conducted using these tools, the results of which are shown in FIGS. 4 and 5. More specifically, FIG. 4 shows the result of the cutting test conducted by effecting a high-speed and low-feed cutting to a material SKD 61 (JIS alloy tool steel) tempered to have a hardness of HRC 45. It will be seen that the lifetimes of the tools substantially conform to the order of the hardness levels of the high-speed tool steels employed in the test. All of the steels in accordance with the invention exhibit superior lifetime as compared with the conventional steels.

FIG. 5 shows the result of the cutting test conducted by effecting a high-speed and high-feed cutting to a material SKD 61 tempered to have a hardness of HRC 40. Also in this case, the tools made from the steels of the invention exhibit superior cutting durability over the tools made from conventional steels. This proves that the steel of the invention has, notwithstanding its high hardness, a toughness of the cutting edge high enough to withstand the severe conditions of high-feed cutting.

Example 2

Powder of a high-speed tool steel containing, by weight, 1.80% of C, 0.3% of Si, 0.3% of Mn, 0.1% of Ni, 4.4% of Cr, 6.8% of W, 9.7% of Mo, 2.2% of V, 8.2% of Co and 0.04% of N was produced by water atomizing method. The powder was mechanically ground and classified by a screen of 350 mesh, so that powder of grain size smaller than 44 μm was obtained. As a result of an analysis, it was proved that the oxygen content of the powder was 2800 ppm.

Then, a powder mixture was formed by mixing together 86.72% of the above-mentioned powder, 8% of TiN powder having a mean grain size of 1.3 μm, 2% of TaC powder having a mean grain size of 3.8 μm, and 2% of VC powder having a mean grain size of 2.1 μm. To the mixture, further added were 0.28% of graphite powder for the purpose of reducing the oxide on the surface of the above-mentioned high-speed tool steel powder, and 1.0% of Ni powder (grain size 1.4 μm) for the purpose of improving the sintering ability. The mixture was then wet-blended by means of a ball mill. After drying, the powder mixture was compacted by pressing under a pressure of 5 t/cm$^2$, followed by a sintering which was conducted in a vacuum for 2 hours at a temperature of 1220° C. The specific gravity of the sintered material substantially approximated the true density. The carbon content of the material after the sintering was 2.24%, while the oxygen content was 340 ppm.

The thus obtained sintered material was, after being annealed, subjected to a hardening-and-tempering treatment consisting of a hardening at 1220° C. and a subsequent tempering conducted three times under a condition of 560° C.×1 hour. The thus treated material exhibited a high hardness of HRC 73.1.

Example 3

Powder of a high-speed tool steel containing, by weight, 1.77% of C, 0.4% of Si, 0.3% of Mn, 0.1% of Ni, 6.3% of Cr, 2.2% of W, 10.3% of Mo, 2.1% of V, 6.2% of Co and 0.04% of N was produced by water atomizing method. The powder was mechanically ground and classified by a screen of 350 mesh, so that powder of grain size smaller than 44 μm was obtained. As a result of an analysis, it was proved that the oxygen content of the powder was 4500 ppm.

Then, a powder mixture was formed by mixing together 88% of the above-mentioned powder, 8% of TiN powder having a mean grain size of 1.3 μm, and 2% of VC powder having a mean grain size of 2.1 μm. To the mixture, further added were 0.45% of graphite powder for the purpose of reducing the oxide on the surface of the above-mentioned high-speed tool steel powder, and 1.55% of Co powder (grain size 1.2 μm) for the purpose of improving the sintering ability. The mixture was then wet-blended by means of a ball mill. After drying, the powder mixture was compacted by pressing under a pressure of 5 t/cm$^2$, followed by a sintering which was conducted for 2 hours at a temperature of 1220° C. The specific gravity of the sintered material substantially approximated the true density. The carbon content of the material after the sintering was 1.92%, while the oxygen content was 230 ppm.

The thus obtained sintered material was, after being annealed, subjected to a hardening-and-tempering treatment consisting of a hardening at 1210° C. and a subsequent tempering conducted three times under a condition of 560° C.×1 hour. The thus treated material exhibited a high hardness of HRC 72.8.

Example 4

Powder of a high-speed tool steel containing, by weight, 3.31% of C, 0.3% of Si, 0.3% of Mn, 0.1% of Ni, 4.1% of Cr, 2.1% of W, 10.3% of Mo, 2.1% of V, 6.2% of Co and 0.04% of N was produced by water atomizing method. The powder was mechanically ground and classified by a screen of 350 mesh, so that powder of grain size smaller than 44 μm was obtained. As a result of an analysis, it was proved that the oxygen content of the powder was 3700 ppm.

Then, a powder mixture was formed by mixing together 94.13% of the above-mentioned powder, 2% of ZrN powder of a mean grain size of 1.6 μm and 2% of ZrN powder of a mean grain size of 3.6 μm. To the mixture, further added were 0.37% of graphite powder for the purpose of reducing the oxide on the surface of the above-mentioned high-speed tool steel powder, and 1.50% of Co powder (grain size 1.2 μm) for the purpose of improving the sintering ability. The mixture was then wet-blended by means of a ball mill. After drying, the powder mixture was compacted by pressing under a pressure of 5 t/cm$^2$, followed by a sintering which was conducted for 2 hours at a temperature of 1220° C. The specific gravity of the sintered material substantially approximated the true density. The carbon content of the material after the sintering was 3.39%, while the oxygen content was 420 ppm.

The thus obtained sintered material was, after being annealed, subjected to a hardening-and-tempering treatment consisting of a hardening at 1210° C. and a subsequent tempering conducted three times under a condition of 560° C.×1 hour. The thus treated material exhibited a high hardness of HRC 72.6.

As mentioned in the foregoing description, the high-speed tool steel of the invention can exhibit, notwithstanding its comparatively low content of expensive alloy element such as W, Mo, V, etc., or of hard material such as TiN, etc., a high hardness of HRC 71 or higher by being subjected to an ordinary hardening-and-tempering treatment and is most suitable for a cutting tool material having an excellent cutting durability.

What is claimed is:

1. A high-speed tool steel capable of high hardness and toughness, formed by preparing an atomized matrix powder of a high-speed tool steel having a composition which satisfies the condition of $0 \leqq C - Ceq \leqq 0.6$ (where $Ceq = 0.06\ Cr + 0.033\ W + 0.063\ Mo + 0.2\ V$) within the range of $1.7 \leqq C \leqq 4.1\%$, said composition containing 3 to 10% Cr, 1 to 20% W, 1 to 15% Mo (where $18 \leqq W + 2\ Mo \leqq 40$) 1 to 15% V, not greater than 15% Co, not greater than 2% Si, not greater than 1% Mn, and the balance of said matrix being substantially Fe and inevitable impurities; uniformly mixing 88 to 98% of said matrix powder and 2 to 12%, based upon the total, of a powder of one or more hard substances selected from the group consisting of nitrides, carbides and carbonitrides mixture.

2. A high-speed tool steel capable of high hardness and toughness accordance to claim 1, wherein said atomized matrix powder has a composition which satisfies the condition of $0 \leqq C - Ceq \leqq 0.6$ within the range of $2.25 \leqq C \leqq 4.1\%$, said composition containing 3 to 10% Cr, 1 to 20% W, 1 to 11% Mo (where $24.1 \leqq W + 2Mo \leqq 40$), 1 to 15%, V, not greater than 15% Co, not greater than 2% Si, not greater than 1% Mn, and the balance substantially Fe and inevitable impurities.

3. A high-speed tool steel capable of high hardness and toughness according to claim 1, wherein said atomized matrix powder has a composition which satisfies the condition of $0.1 \leqq C - Ceq \leqq 0.6$ within the range of $2.0 \leqq C \leqq 3.5\%$, said composition containing 3 to 10% Cr, 1 to 20% W, 1 to 11% Mo (where $18 \leqq W + 2Mo \leqq 24$). 5.6 to 15%, V, not greater than 15% Co, not greater than 2% Si, not greater than 1% Mn, and the balance substantially Fe and inevitable impurities.

4. A high-speed tool steel capable of high hardness and toughness according to claim 1, wherein said atomized powder has a composition which satisfies the condition of $0 \leqq C - Ceq \leqq 0.6$ (where $Ceq = 0.06\ Cr + 0.033\ W + 0.063\ Mo + 0.2\ V$) within the range of $1.7 \leqq C \leqq 2.8\%$, said composition containing 3 to 10% Cr, 1 to 20% W, 1 to 11% Mo (where $18 \leqq W + 2Mo \leqq 24$), 1 to 5.5% V, not greater than 15% Co, not greater than 2% Si, not greater than 1% Mn, and the balance substantially Fe and inevitable impurities.

5. A high-speed tool steel capable of high hardness and toughness according to any one of claims 1 thru 4, further containing not greater than 2% Ni and not greater than 0.1% N.

6. A high-speed tool steel having high hardness and toughness according to claim 14, wherein said steel exhibits a hardness not lower than HRC 72 after a hardening-and-tempering treatment.

7. A high-speed tool steel having high hardness and toughness according to claim 3, wherein said steel exhibits a hardness not lower than HRC 72 after a hardening-and-tempering treatment.

* * * * *

UNITED STATES PATENT AND TRADEMARK OFFICE

CERTIFICATE OF CORRECTION

PATENT NO. : 4,880,461

DATED : November 14, 1989

INVENTOR(S) : Norimasa Uchida

It is certified that error appears in the above-identified patent and that said Letters Patent is hereby corrected as shown below:

Claim 1, col. 12, line 18:

"carbonitrides" should be followed by --of Ti, V, Zr, Nb, Hf and Ta and compacting and sintering the--.

Abstract, line 3, "V" should be followed by --)--.

Signed and Sealed this

Sixteenth Day of October, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,880,461

DATED : November 14, 1989

INVENTOR(S) : Norimasa Uchida

It is certified that error appears in the above-identified patent and that said Letters Patent is hereby corrected as shown below:

In the front page of the patent specification, under Foreign Application Priority Data, change "Aug. 18, 1985" on all three lines to --Aug. 19, 1985--.

Signed and Sealed this

Twentieth Day of August, 1991

*Attest:*

HARRY F. MANBECK, JR.

*Attesting Officer*

*Commissioner of Patents and Trademarks*